US008103193B2

(12) United States Patent
Isobe et al.

(10) Patent No.: US 8,103,193 B2
(45) Date of Patent: Jan. 24, 2012

(54) IMAGE FORMING APPARATUS

(75) Inventors: Akifumi Isobe, Hidaka (JP); Ryuji Okutomi, Hino (JP); Hiroyuki Watanabe, Toyokawa (JP); Tadayuki Ueda, Kokubunji (JP); Yoshihito Sasamoto, Hachioji (JP); Takashi Nara, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 491 days.

(21) Appl. No.: 12/412,656

(22) Filed: Mar. 27, 2009

(65) Prior Publication Data

US 2009/0257778 A1 Oct. 15, 2009

(30) Foreign Application Priority Data

Apr. 9, 2008 (JP) ..... 2008-101489

(51) Int. Cl.
*G03G 15/00* (2006.01)

(52) U.S. Cl. ..... 399/167

(58) Field of Classification Search ..... 399/167, 399/228

See application file for complete search history.

(56) References Cited

U.S. PATENT DOCUMENTS

| | | | | |
|---|---|---|---|---|
| 5,933,687 | A * | 8/1999 | Okuno et al. | 399/167 |
| 2003/0180072 | A1 * | 9/2003 | Ohashi et al. | 399/167 |
| 2007/0077090 | A1 * | 4/2007 | Kim et al. | 399/167 |
| 2007/0253735 | A1 * | 11/2007 | Sato | 399/167 |
| 2009/0123182 | A1 * | 5/2009 | Sasamoto et al. | 399/167 |

FOREIGN PATENT DOCUMENTS

JP 2000-310922 A 11/2000

* cited by examiner

*Primary Examiner* — David Gray
*Assistant Examiner* — Rodney Bonnette
(74) *Attorney, Agent, or Firm* — Buchanan Ingersoll & Rooney PC

(57) ABSTRACT

An image forming apparatus having a color mode and a monochromatic mode, which includes: a transmission member, which can be switched between a transmitted state where a motor transfers a drive force to a single photoreceptor drum and a non-transmitted state where the motor does not transfer the drive force to the single photoreceptor drum; and a controller which switches to the non-transmitted state while executing an image formation in the monochromatic mode, and when a command to execute a next image formation is not instructed, switches to the transmitted state after a phase adjustment of each photoreceptor drum after the image formation in the monochromatic mode, and controls the motor to execute a slight rotation operation at every prescribed period of time by synchronizing plural drums including the single photoreceptor drum with each other through the transmission member.

7 Claims, 6 Drawing Sheets

IMAGE FORMING APPARATUS

This application is based on Japanese Patent Application No. 2008-101489 filed on Apr. 9, 2008, which is incorporated hereinto by reference.

BACKGROUND OF THE INVENTION

The present invention relates to an image forming apparatus.

So far, the image forming apparatus that is capable of performing image formation in both of a color mode and a monochromatic mode has been known. In such an image forming apparatus, there is an image forming apparatus, which is capable of changing a position of a transfer conveyance belt at the time of standby in order to prevent a first copy out time from becoming long, the first copy out time being a period of time from the time when a command of image formation is issued until the image formation is completed. Concretely, when the usage frequency of a color mode is high, the transfer conveyance belt will be made to be in a standby state in the color mode with reference to the past usage history of this image forming apparatus. When the usage frequency of a monochromatic mode is high, the transfer conveyance belt will be put to a standby state in the monochromatic mode. Further, this image forming apparatus is capable of setting the apparatus to a standby state in the color mode, to a standby state in the monochromatic mode or to a middle standby state as a default configuration (refer to Unexamined Japanese Patent Application Publication No. 2000-310922).

Here, in the image forming apparatus of the conventional tandem system, since a phase of each photoreceptor drums of yellow, magenta, cyan and black deviates after the end of the image formation in the monochromatic mode, a phase adjusting process is performed. Thereby, when there is a command of image formation in a color mode, since the phase adjusting process has been completed, the image formation in a color mode can be quickly performed, and the extension of the first copy out time has been prevented.

However, when the conventional image forming apparatus is arranged to be in a standby state while stopping a photoreceptor drum in the state that a phase adjustment has been completed, it will become the causes of image blur caused by ozone and image deterioration due to humidity. Thus, it is possible to perform a slight rotation of the photoreceptor drum to regulate the image blur caused by ozone and the image deterioration due to humidity. When the slight rotation is performed, the image blur caused by ozone and the image deterioration due to humidity can be regulated. However, since the phase deviation occurs due to the difference of load of each motor, which operates each of the photoreceptor drum of yellow, the photoreceptor drum of magenta, the photoreceptor drum of cyan and the photoreceptor drum of black, it is necessary to perform the phase adjusting process again.

As described above, although the phase adjustment is performed in the conventional image forming apparatus so as to shorten the first copy out time, neither the image blur caused by ozone nor the image deterioration due to humidity can be regulated. When slight rotation is performed to prioritize the regulation of the image blur caused by ozone and the image deterioration due to humidity, it is necessary to perform the phase adjusting process again. Therefore, it will become the cause of the extension of the first copy out time.

SUMMARY OF THE INVENTION

An object of the present invention is to provide an image forming apparatus, which is capable of suppressing image blur caused by ozone and image deterioration due to humidity, while shortening a first copy out time to solve such a conventional problem.

According to one embodiment, in an image forming apparatus having a color mode in which a color image is formed on a recording medium by rotating and driving a plurality of photoreceptor drums, and a monochromatic mode in which a monochromatic image is formed on a recording medium by a single photoreceptor drum of the plurality of photoreceptor drums by rotating and driving the single photoreceptor drum, the image forming apparatus includes: a first motor which rotates only the single photoreceptor drum of the plurality of photoreceptor drums; a second motor which rotates the plurality of photoreceptor drums; a transmission member, which is capable of being switched between a transmitted state where the second motor transfers a drive force to the single photoreceptor drum and a non-transmitted state where the second motor does not transfer the drive force to the single photoreceptor drum; and a controller which controls a rotation speed of the second motor and a switching of the transmission member between the transmitted state and the non-transmitted state. The controller switches the transmission member to the non-transmitted state while executing an image formation in the monochromatic mode, and when a command to execute a next image formation is not instructed after having executed the image formation in the monochrome mode, switches the transmission member to the transmitted state after a phase adjusting process that adjusts a phase of each photoreceptor drum has been completed, and controls the second motor to execute a slight rotation operation which executes a slight rotation at every prescribed period of time by synchronizing the plurality of photoreceptor drums including the single photoreceptor drum with each other through the transmission member after the transmission member has been switched to the transmitted state.

Here, "image formation" implies "each process of charge, imagewise exposure, development and transfer is sequentially executed onto a photoreceptor drum while rotating the photoreceptor drum". Thus, "execution of image formation" will be also referred to as, for example, "execution of each process" hereinafter.

BRIEF DESCRIPTION OF THE DRAWINGS

FIG. 2(*a*) illustrates the configuration of the drive mechanism in a non-transmitted state and FIG. 2(*b*) illustrates the configuration of the drive mechanism in a transmitted state.

FIG. 3(*a*) illustrates the configuration of the drive mechanism in the non-transmitted state and FIG. 3(*b*) illustrates the configuration of the drive mechanism in the transmitted state.

DETAILED DESCRIPTION OF THE PREFERRED EMBODIMENTS

Although the present invention will be described based on embodiments of the present invention below, the present invention is not limited to the embodiments.

Figure 1:
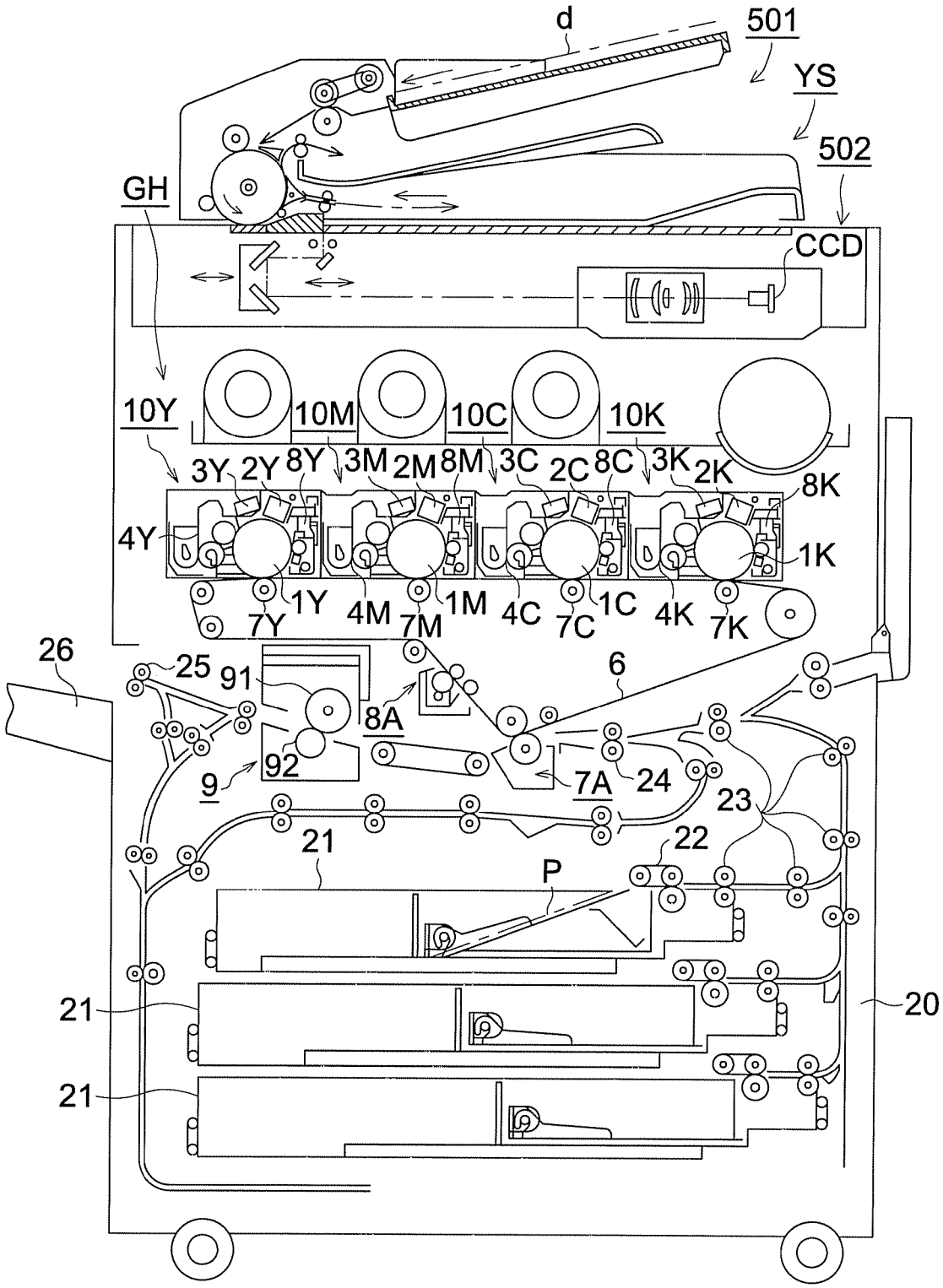
FIG. 1 illustrates an entire configuration diagram of an image forming apparatus related to an embodiment.

FIG. 1 illustrates an entire configuration of an image forming apparatus related to this embodiment. For example, the image forming apparatus related to this embodiment is a copying machine. The image forming apparatus reads an image formed on a document "d", acquires image information, and forms an image on sheet P based on the acquired image information. This image forming apparatus is arranged so as to be able to perform image formation in a color mode and a monochromatic mode. Here, the color mode is a mode that performs each process of charging, image exposure, development and transfer on a plurality of photoreceptor drums 1Y, 1M, 1C and 1K in sequence while rotating these photoreceptor drums 1Y, 1M, 1C and 1K (also referred to as execution of image formation). On the other hand, the monochromatic mode is a mode that performs each above-mentioned process on a single photoreceptor drum 1K among the plurality of photoreceptor drums 1Y, 1M, 1C and 1K in sequence while rotating the single photoreceptor drum 1K (also referred to as execution of image formation). Hereafter, the image forming apparatus will be described in detail.

The image forming apparatus related to this embodiment is configured by an image forming unit GH and an image reading device YS. The image forming unit GH is a tandem type color image forming unit. The image forming unit GH is configured by a plurality of sets of image forming units 10Y, 10M, 10C and 10K, an intermediate transfer member 6 and a secondary transfer section 7A.

On the upper section of the image forming unit GH, there is provided the image reading device YS, which is configured by an automatic document feeder 501 and a scanning and exposing device 502. A document "d", which is placed on the document platen of the automatic document feeder 501, is conveyed by a conveyance section. Then an image on one side or both sides of the document "d" is scanned and imagewise exposed by the optical system of the scanning and exposing device 502. Then the image is read in by a line image sensor CCD.

An image signal, to which a photoelectric conversion has been performed by the line image sensor CCD, is supplied to an image processing section 43 (refer to FIG. 4) after an A/D conversion was performed. The image signal is transmitted to imagewise exposure sections 3Y, 3M, 3C and 3K after a shading correction and an image compression processing are performed in the image processing section 43.

The image forming unit 10Y, which forms the image of yellow (Y) color, is configured by a charging section 2Y, an imagewise exposure 3Y, a developing section 4Y, a primary transfer section 7Y and a cleaning section 8Y, which are arranged around a photoreceptor drum 1Y (specific photoreceptor drum). The image forming unit 10M, which forms the image of magenta (M) color, is configured by a charging section 2M, an imagewise exposure 3M, a developing section 4M, a primary transfer section 7M and a cleaning section 8M, which are arranged around a photoreceptor drum 1M (specific photoreceptor drum). The image forming unit 10C, which forms the image of cyan (C) color, is configured by a charging section 2C, an imagewise exposure 3C, a developing section 4C, a primary transfer section 7C and a cleaning section 8C, which are arranged around a photoreceptor drum 1C (specific photoreceptor drum). The image forming unit 10K, which forms the image of black (Bk) color, is configured by a charging section 2K, an imagewise exposure 3K, a developing section 4K, a primary transfer section 7K and a cleaning section 8K, which are arranged around a photoreceptor drum 1K (specific photoreceptor drum). A latent image forming section is configured by the charging section 2Y and the imagewise exposure section 3Y, the charging section 2M and the imagewise exposure section 3M, the charging section 2C and the imagewise exposure section 3C and the charging section 2K and the imagewise exposure section 3K.

The developing sections 4Y, 4M, 4C and 4K contain a two-component developer that is composed of toner and career of yellow (Y), magenta (M), cyan (C) and black (K), respectively.

The intermediate transfer member 6 is entrained about plural rollers and is rotatably supported. A fixing device 9 has a fixing roller 91 and a pressure roller 92. The fixing device 9 fixes a toner image onto a sheet P by heating and pressuring at a nip section created between the fixing roller 91 and the pressure roller 92.

The toner image of each color formed by the image forming units 10Y, 10M, 10C and 10K is transferred one by one onto the rotating intermediate transfer member 6 by the primary transfer sections 7Y, 7M, 7C and 7K. Then a color toner image onto which the toner image of each color is superimposed is formed on the intermediate transfer member 6.

The sheet P loaded in a sheet feed tray 21 is separated in each sheet by sheet feed rollers 22 of a sheet feeding section 20. Then the sheet P is fed to registration rollers 24, which is in a stopped state, through sheet feed rollers 23. The sheet P is stopped at the registration rollers 24. Then the sheet P is fed to the secondary transfer section 7A when the registration rollers start to rotate at the timing when the positions of the leading edge of sheet P and the toner image on the intermediate transfer member 6 coincide with each other. Then the color toner image is secondarily transferred onto the sheet P. The sheet P onto which the color toner image was transferred is heated and pressured in the fixing device 9. Then the color toner image is fixed onto the sheet P. Then, the sheet P is nipped by sheet ejection rollers 25, and is placed on a delivery tray 26 outside the apparatus.

Meanwhile, after the color toner image was transferred onto the sheet P by the secondary transfer section 7A, the residual toner on the intermediate transfer member 6, which performed a curling separation to the sheet P, is removed by the intermediate transfer member cleaning section 8A.

Figure 2:
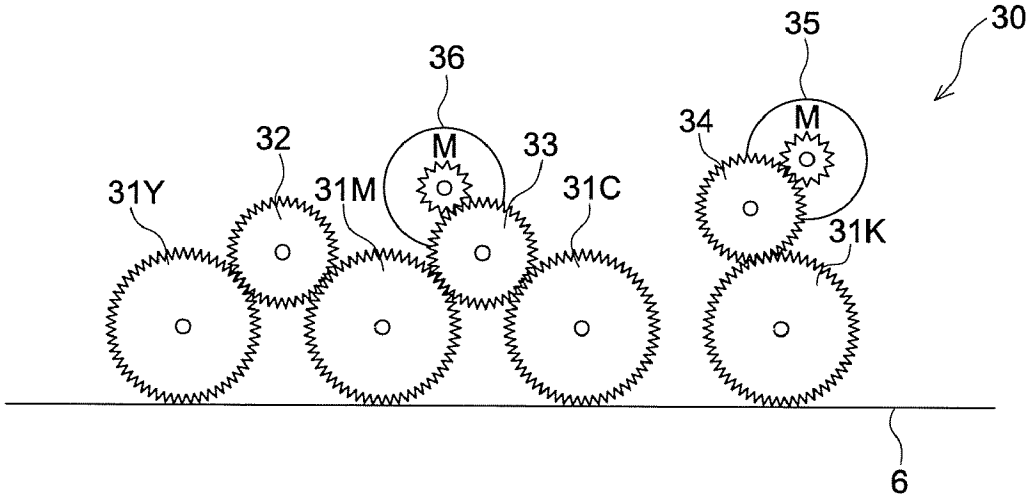
FIGS. 2(*a*)-2(*b*) illustrate a configuration of a drive mechanism for driving each photoreceptor drum illustrated in FIG. 1.
Figure 2:
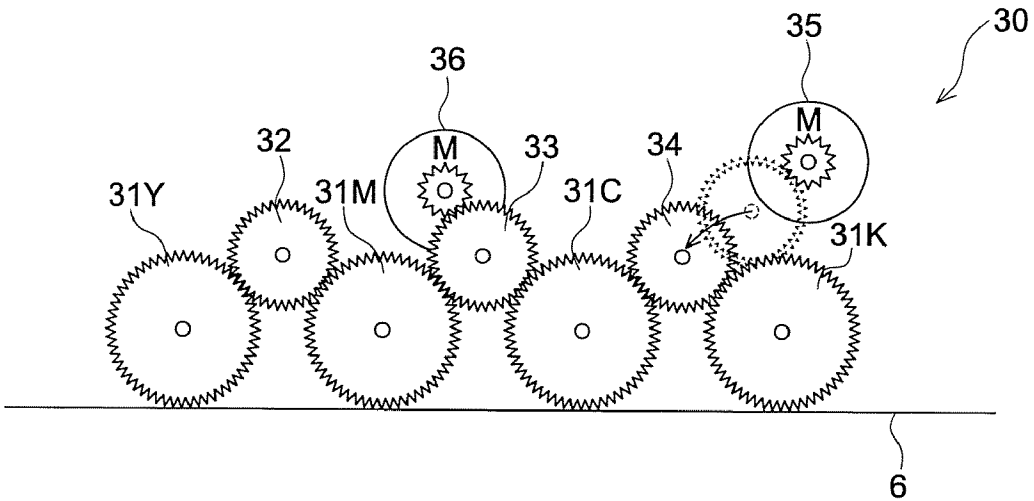

FIGS. 2(*a*)-2(*b*) illustrate a configuration of a drive mechanism 30 for driving each photoreceptor drums 1Y, 1M, 1C and 1K illustrated in FIG. 1. As illustrated in FIG. 2(*a*), the drive mechanism 30 is configured by a plurality of drum gears 31Y, 31M, 31C and 31K, a plurality of idler gears 32 and 33, a movable idler gear 34 as a transmission member, and a plurality of motors 35 and 36.

The plurality of drum gears 31Y, 31M, 31C and 31K is connected to each photoreceptor drums 1Y, 1M, 1C and 1K through the same axis. Concretely, a first drum gear 31Y is connected to the photoreceptor drum 1Y of the image forming unit 10Y, which forms the image of the yellow (Y) color. A second drum gear 31M is connected to the photoreceptor drum 1M of the image forming unit 10M, which forms the image of the magenta (M) color. A third drum gear 31C is connected to the photoreceptor drum 1C of the image forming unit 10C, which forms the image of the cyan (C) color. A fourth drum gear 31K is connected to the photoreceptor drum 1K (henceforth black photoreceptor drum 1K) of the image forming unit 10K, which forms the image of the black (Bk) color.

The plurality of idler gears 32 and 33 is connected to the first to the third drum gears 31Y, 31M and 31C in a state where the teeth of the gears are engaged. Concretely, a first idler gear 32 is provided between the first drum gear 31Y and the second drum gear 31M, and connects the first drum gear 31Y and the second drum gear 31M. A second idler gear 33 is provided between the second drum gear 31M and the third drum gear 31C, and connects the second drum gear 31M and the third drum gear 31C. A movable idler gear 34 is connected to the fourth drum gear 31K in a state where the teeth of the gears are engaged.

A plurality of motors 35 and 36 rotate each drum gears 31Y, 31M, 31C and 31K via each of idler gears 32-34. Concretely, a first motor 35 within the plurality of motors 35 and 36 rotates the fourth drum gear 31K via the movable idler gear 34. Therefore, the first motor 35 can only rotate the black photoreceptor drum 1K. A second motor 36 rotates the first to the third drum gears 31Y, 31M and 31C via the second idler gear 33. Therefore, the second motor 36 can rotate the other three specific photoreceptor drums 1Y, 1M and 1C excluding the black photoreceptor drum 1K.

As illustrated in FIG. 2(*b*), the state of the movable idler gear 34 can be switched to a transmitted state, in which the driving force of the second motor 36 is transmitted to the fourth drum gear 31K (state illustrated in FIG. 2(*b*)), and to a non-transmitted state, in which the driving force of the second motor 36 is not transmitted to the fourth drum gear 31K (state illustrated in FIG. 2(*a*)).

To describe in more detail, the movable idler gear 34 will switch the drive mechanism to the non-transmitted state when performing the image formation in the monochromatic mode. The first motor 35 is driven, the fourth drum gear 31K is rotated, and only the black photoreceptor drum 1K rotates. During this time, the second motor 36 is not driven and the first to the third drum gears 31Y, 31M and 31C will be in the stopped state.

On the other hand, the movable idler gear 34 will switch the drive mechanism to the transmitted state when performing the image formation in the color mode. The second motor 36 is driven, each drum gears 31Y, 31M, 31C and 31K is rotated via each idler gears 32-34, and each photoreceptor drums 1Y, 1M, 1C, and 1K rotates.

Figure 3:
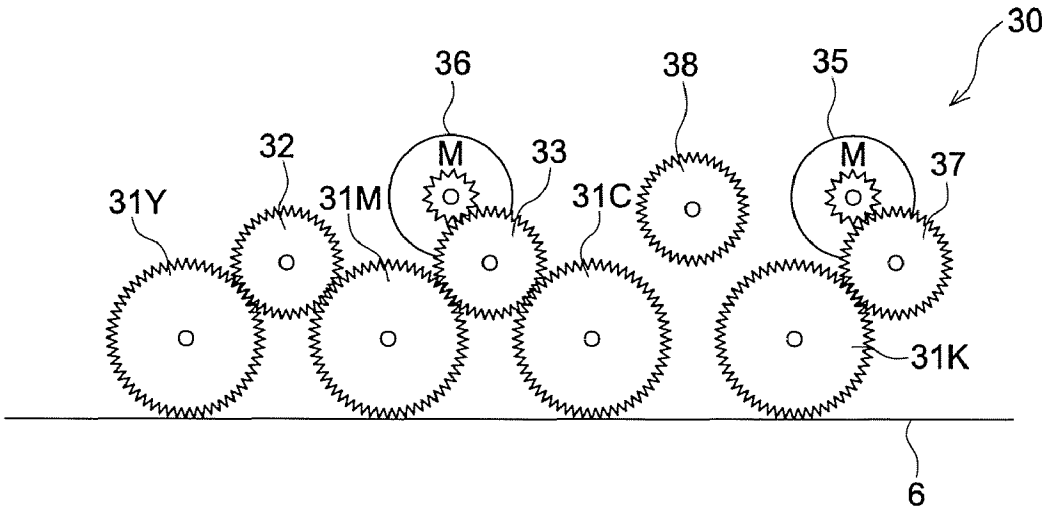
FIGS. 3(*a*)-3(*b*) illustrate a configuration of another example of the drive mechanism for driving each photoreceptor drum illustrated in FIG. 1.
Figure 3:
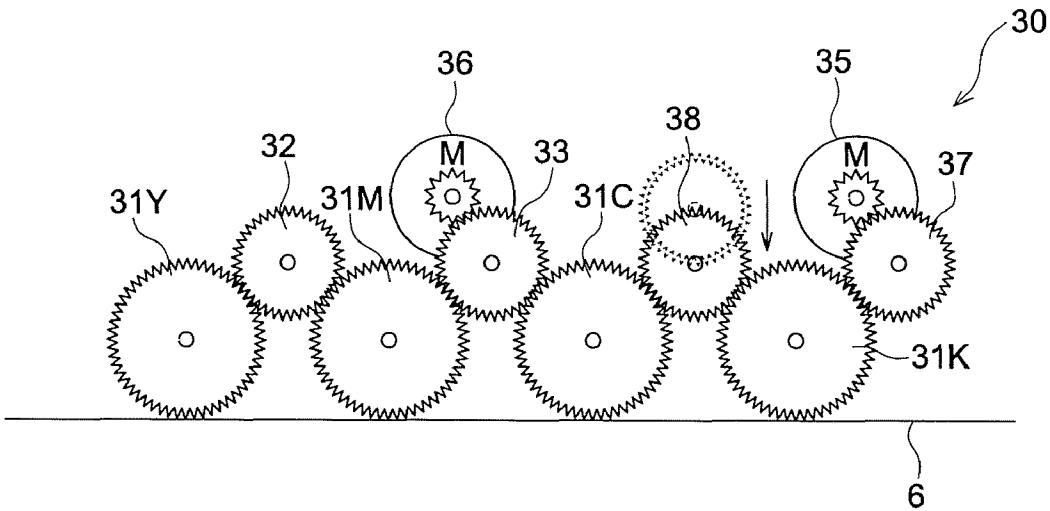

FIGS. 3(*a*)-3(*b*) illustrate a configuration of another example of the drive mechanism 30 for driving each photoreceptor drums 1Y, 1M, 1C and 1K illustrated in FIG. 1. The drive mechanism 30 may be arranged to have a configuration illustrated in FIGS. 3(*a*)-3(*b*) in place of the example illustrated in FIGS. 2(*a*)-2(*b*). That is, the drive mechanism 30 may be provided with a third idler gear 37 and a vertical motion idler gear 38 as a transmission member in place of the movable idler gear 34.

In this example, the third idler gear 37 is connected to the fourth drum gear 31K in a state where the teeth of the gears are engaged. The vertical motion idler gear 38 is provided between the third drum gear 31C and the fourth drum gear 31K. The state of the vertical motion idler gear 38 can be switched to a state in which the teeth of the vertical motion idler gear 38 and the teeth of the third drum gear 31C and the fourth drum gear 31K are engaged (a transmitted state illustrated in FIG. 3(*b*)) and to a state in which the teeth of the vertical motion idler gear 38 and the teeth of the third drum gear 31C and the fourth drum gear 31K are separated (state illustrated in FIG. 3(*a*)).

In this configuration, the vertical motion idler gear 38 will be in the state illustrated in FIG. 3(*a*) at the time of the monochromatic mode. The fourth drum gear 31K can only be rotated by the driving force of the first motor 35. On the other hand, the vertical motion idler gear 38 will be in the state illustrated in FIG. 3(*b*) at the time of the color mode. The first to the fourth drum gears 31Y, 31M, 31C and 31K will be synchronously rotated by the driving force of the second motor 36.

Figure 4:
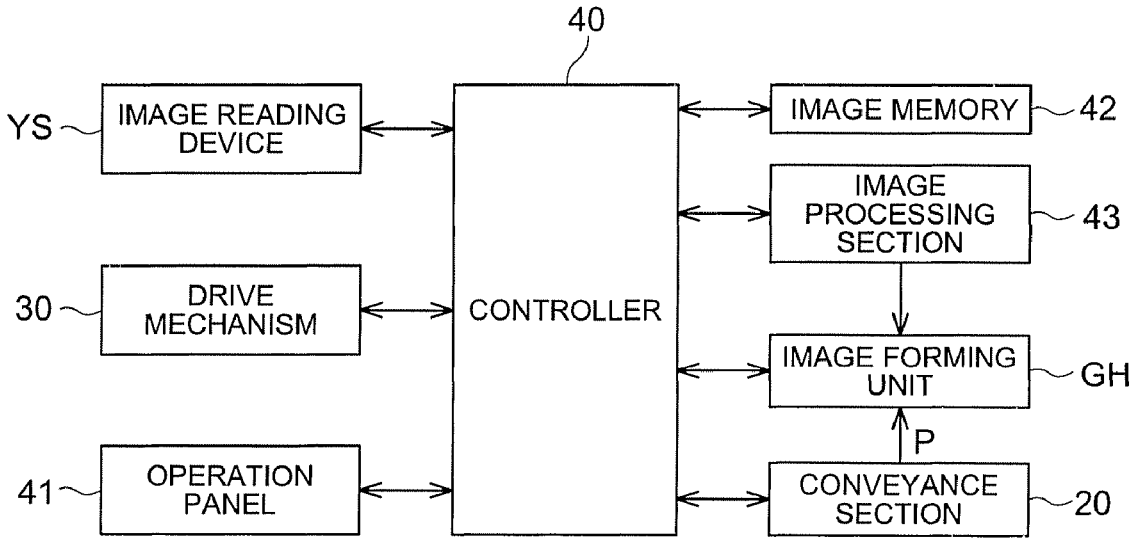
FIG. 4 illustrates a block diagram of a control configuration of the image forming apparatus illustrated in FIG. 1.

FIG. 4 illustrates a block diagram of a control configuration of the image forming apparatus illustrated in FIG. 1. In addition to the configuration illustrated in FIG. 1, the image forming apparatus has a controller 40, an operation panel 41, an image memory 42 and the image processing section 43.

The controller 40 has CPU (Central Processing Unit), ROM (Read Only Memory) and RAM (Random Access Memory) that provides the data storage area for operation. The system program data for controlling the entire image forming apparatus is stored in ROM of the controller 40. When the power source of the image forming apparatus is turned on, the controller 40 reads out the system program data from ROM and starts the system. Then, the controller 40 controls the entire image forming apparatus.

For example, the operation panel 41 may be a touch panel, which is configured by a matrix switch that is combined with a display monitor of a liquid crystal display (LCD). A user can perform the printing instructions in the color mode and the printing instructions in the monochromatic mode by operating this operation panel 41. By operating the operation panel 41, the user can perform an instruction of number of printing for continuously printing, an instruction of enlargement and reduction ratio of a printing material, an instruction of image formation on a sheet type or on one or both sides of the sheet, an instruction of selection of sheet feeding cassette, an instruction of setting on output image concentration and an instruction of selecting sheet size.

The image memory 42 stores the image data read by the image reading device YS as the image data of a RGB color system. The image memory 42 is configured by a hard disk or semiconductor memory. The image processing section 43 reads the image data of the RGB color system from the image memory 42, and performs color conversion on image data Dy, Dm, Dc and Dk of a YMCK color system. The image processing section 43 supplies the image data Dy, Dm, Dc and Dk of the YMCK color system to the image forming unit GH. By this, the image forming unit GH drives each sections and performs image formation based on the inputted information.

In such control configuration, when the document "d" is placed on the document platen of the automatic document feeder 501, the controller 40 transmits a signal for instructing the image reading device YS to perform image reading. Thereby, the image reading device YS conveys the document "d" with the conveyance section, and the image of one side or both sides of the document is scanned and imagewise exposed with the optical system of the scanning and exposing device 502. Then, the image is read by the line image sensor CCD.

Then, the controller 40 stores the image data read by the line image sensor CCD onto the image memory 42. The image processing section 43 reads the image data of the RGB color system from the image memory 42, performs color conversion to the image data Dy, Dm, Dc and Dk of the YMCK color system and supplies the image data Dy, Dm, Dc and Dk to the image forming unit GH. And the image forming units 10Y, 10M, 10C and 10K of the image forming unit GH execute each process of charging, image exposure, development and transfer (image formation), and perform image formation to the intermediate transfer member 6.

On the other hand, a conveyance section 20 feeds the sheet P through the sheet feed rollers 22 and 23 and sends the sheet P to the registration rollers 24 that is in the stopped state. The conveyance section 20 stops the sheet P at the registration rollers 24. The conveyance section 20 feeds the sheet P to the secondary transfer section 7A when the registration rollers starts to rotate at the timing when the positions of the leading edge of sheet P and the toner image on the intermediate transfer member 6 coincide with each other. Then the color toner image is secondarily transferred onto the sheet P.

In this embodiment, the controller 40 controls the drive mechanism 30. That is, when there is an instruction of the image formation in the monochromatic mode, the controller switches the transmission member to the non-transmitted state. The first motor 35 is driven and only the black photoreceptor drum 1K is rotated.

Further, when the execution of next image formation has not been instructed after the image formation is performed in the monochromatic mode, the controller 40 performs a phase adjusting process for adjusting the phase of each photoreceptor drums 1Y, 1M, 1C and 1K in order to agree the phase with each other. At this time, the controller 40 rotates only the first motor 35 to adjust the phase, rotates only the second motor 36 to adjust the phase or rotates both the first motor 35 and the second motor 36 to adjust the phase. Then, controller 40 switches the transmission member to the transmitted state after the end of phase adjusting process.

Subsequently, for every prescribed period of time, the controller 40 drives the second motor 36 and performs slight rotation to three drum gears 31Y, 31M and 31C. By this, three specific photoreceptor drums 1Y, 1M and 1C are slightly rotated a prescribed angle of not more than one round. By this slight rotation, the image blur caused by ozone and the image deterioration due to humidity of the three photoreceptor drums 1Y, 1M and 1C can be suppressed. In particular, at the time of this slight rotation, the transmission member is in the transmitted state. Therefore, the fourth drum gear 31K will synchronize with other three drum gears 31Y, 31M and 31C to be slightly rotated. The black photoreceptor drum 1K will also synchronize to be slightly rotated. Thereby, the slight rotation is performed without deviating the adjusted phase of each photoreceptor drums 1Y, 1M, 1C and 1K. Therefore, the image blur caused by ozone and the image deterioration due to humidity of the black photoreceptor drum 1K can also be suppressed.

Figure 5:
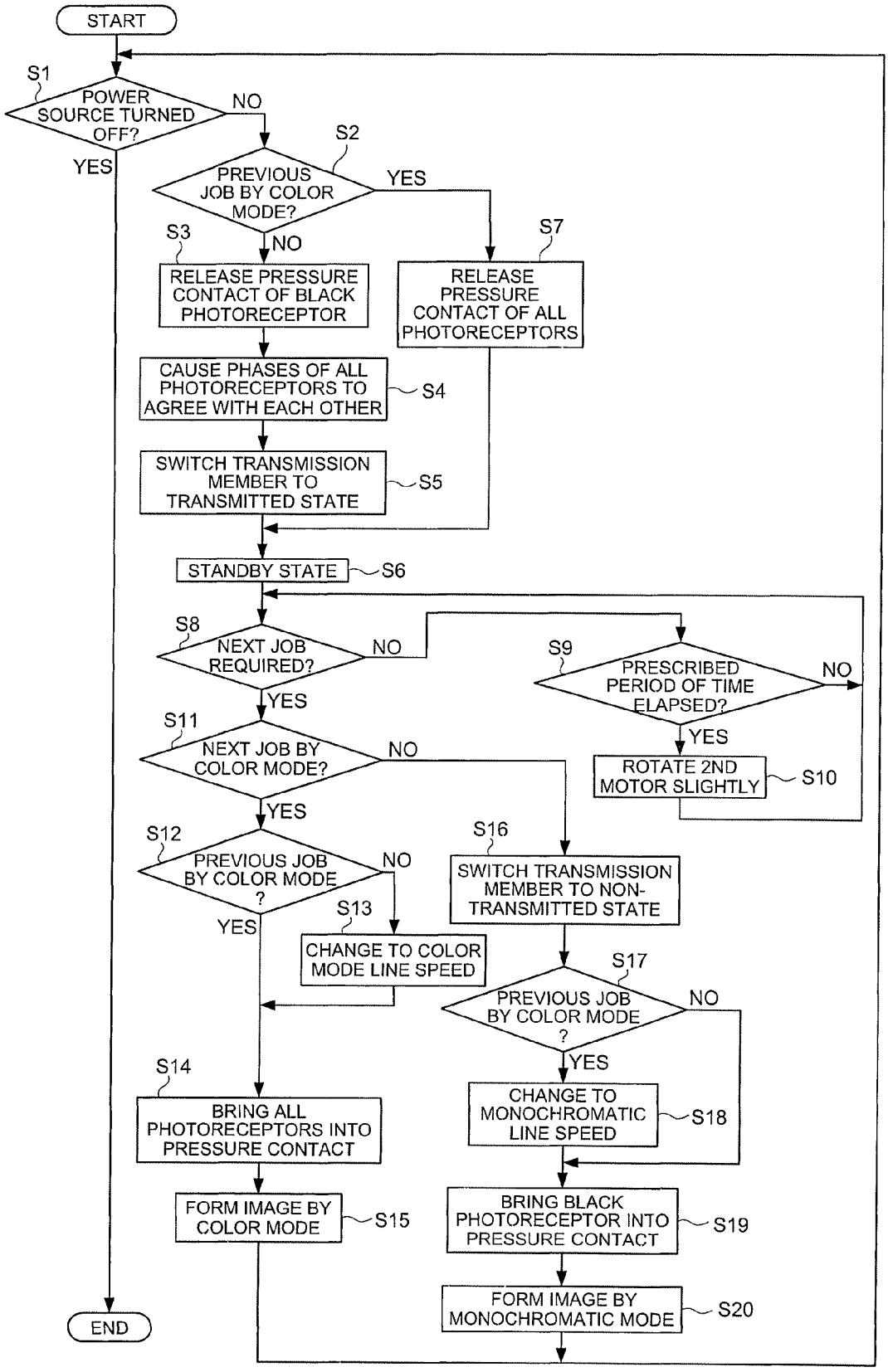
FIG. 5 illustrates a flow chart showing a detailed operation of the image forming apparatus related to the embodiment, and illustrates an operation of a case in which there is no continuous job.

Next, a detailed operation of the image forming apparatus related to this embodiment will be described. FIG. 5 illustrates a flow chart of the detailed operation of the image forming apparatus related to this embodiment. FIG. 5 illustrates an operation of a case in which there is no continuous job. First, as illustrated in FIG. 5, the controller 40 determines whether the power source of the image forming apparatus is turned off or not (S1). When the power source is determined to be turned off (S1: YES), the process illustrated in FIG. 5 ends.

On the other hand, when the power source is determined not to be turned off (S1: NO), the controller 40 determines whether a previous job of the image formation was in the color mode or not (S2). When the previous job of the image formation was not in the color mode (S2: NO), that is, when the previous job of the image formation was in monochromatic mode, the controller 40 releases pressure contact of the black photoreceptor drum 1K and the intermediate transfer member 6 (S3). Then the controller 40 performs the phase adjusting process to adjust phase of each photoreceptor drums 1Y, 1M, 1C and 1K (S4) so that each phase agrees with each other. Next, the controller 40 switches the transmission member into the transmitted state (S5). The image forming apparatus will be in a standby state (S6).

When the previous job of the image formation was determined to be in the color mode (S2: YES), the controller 40 releases pressure contact of the photoreceptor drums 1Y, 1M, 1C and 1K and the intermediate transfer member 6 (S7). Then the process proceeds to Step S6. That is, since the previous job of the image formation was in the color mode, the transmission member is in the transmitted state. Therefore, the controller 40 does not need to switch the transmission member to the transmitted state. Thus, the transmitted state is maintained. Since the previous job of the image formation was in the color mode and the phase adjusting process is not needed, the controller 40 only releases the pressure contact of all the photoreceptor drums 1Y, 1M, 1C, and 1K and the intermediate transfer member 6 and the process proceeds to Step S6.

After Step S6, the controller 40 determines whether there is a demand for the next job or not (S8). When it is determined that there is no demand for the next job (S8: NO), the controller 40 determines whether the prescribed period of time has elapsed or not since the time when the image forming apparatus was put in the standby state in Step S6 or since the previous prescribed period of time has elapsed (S9). When the prescribed period of time is determined not to have elapsed (S9: NO), the process proceeds to Step S8. On the other hand, when the prescribed period of time was determined to have elapsed (S9: YES), the controller 40 performs the slight rotation to the second motor 36 (S10). At this time, the transmission member is in the transmitted state. Therefore, all of the drum gears 31Y, 31M, 31C and 31K are rotated for a prescribed angle. The image blur caused by ozone or the image deterioration due to humidity can be regulated without the phase of each photoreceptor drums 1Y, 1M, 1C and 1K being deviated. Then, the process proceeds to Step S8.

Incidentally, when it is determined that there was a demand for the next job (S8: YES), the controller 40 determines whether the next job is an image formation in the color mode or not (S11). When the next job is determined to be the image formation in the color mode (S11: YES), the controller 40 determines whether the previous job was the image formation in the color mode or not (S12). When the previous job is determined to be the image formation in the color mode (S12: YES), the process proceeds to Step S14.

On the other hand, when the previous job is determined not to be the image formation in the color mode (S12: NO), the controller 40 controls the image forming unit GH, and switches the line speed, which is the copying speed, to a color mode line speed (S13). Next, the controller 40 brings all of the photoreceptor drums 1Y, 1M, 1C and 1K in pressure contact with the intermediate transfer member 6 (S14), and executes the image formation in the color mode (S15).

When the next job is determined not to be the image formation in the color mode (S11: NO), that is when the next job is the image formation in the monochromatic mode, the controller 40 switches the transmission member from the transmitted state to the non-transmitted state (S16). The controller 40 determines whether the previous job was the image formation in the color mode or not (S17). When the previous job is determined not to be the image formation in the color mode (S17: NO), the process proceeds to Step S19.

When the previous job is determined to be the image formation in the color mode (S17: YES), the controller 40 controls the image forming unit GH, and switches the line speed to the monochromatic mode line speed (S18). Next, the controller 40 brings the black photoreceptor drum 1K in pressure contact with the intermediate transfer member 6 (S19), and executes the image formation in the monochromatic mode (S20).

Figure 6:
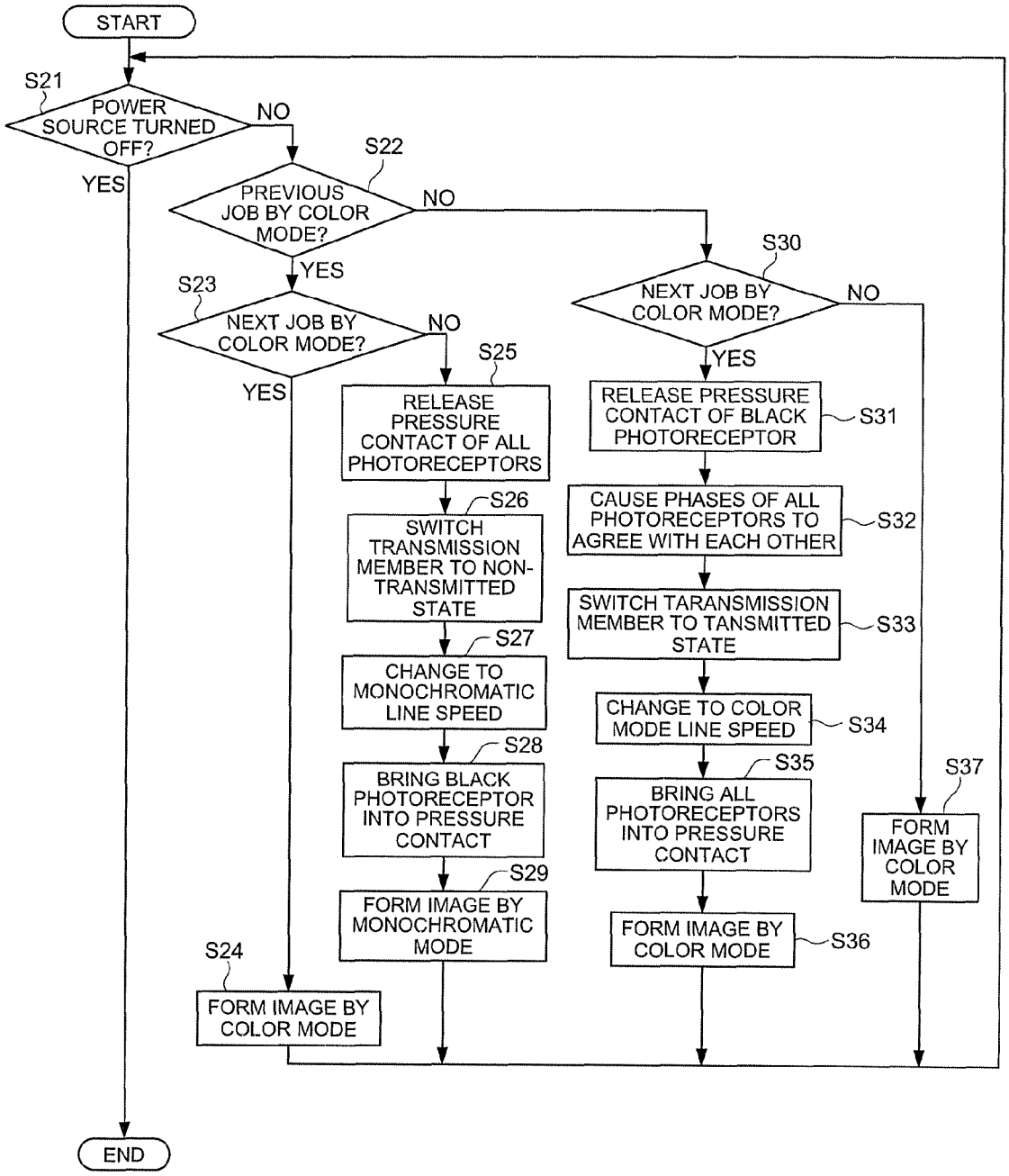
FIG. 6 illustrates a flow chart showing a detailed operation of the image forming apparatus related to the embodiment, and illustrates an operation of a case in which there is stacked job.

Next, a case where there is a continuous job will be described in reference to FIG. 6. FIG. 6 illustrates a flow chart of a detailed operation of the image forming apparatus related to this embodiment. FIG. 6 illustrates an operation when there is a continuous job. First, as illustrated in FIG. 6, the controller 40 determines whether the power source of the image forming apparatus is turned off or not (S21). When the power source is determined to be turned off (S21: YES), the process illustrated in FIG. 6 ends.

On the other hand, when the power source is determined not to be turned off (S21: NO), the controller 40 determines whether the previous job was the image formation in the color mode or not (S22). When the previous job is determined to be the image formation in the color mode (S22: YES), the controller 40 determines whether the next job will be the image formation in the color mode or not (S23). When the next job is determined to be the image formation in the color mode (S23: YES), that is, when the image formation in the color mode continues from the previous job to the next job, the controller 40 executes the image formation in the color mode (S24). Then, the process proceeds to Step S21.

On the other hand, when the next job is determined not to be the image formation in the color mode (S23: NO), that is, when the image formation in the color mode is switched to the image formation in the monochromatic mode, the controller 40 releases the pressure contact of all of the photoreceptor drums 1Y, 1M, 1C and 1K and the intermediate transfer member 6 (S25). Then, the controller 40 switches the transmission member from the transmitted state to the non-transmitted state (S26).

Next, the controller 40 controls the image forming unit GH, and switches the line speed to the monochromatic mode line speed (S27). Subsequently, the controller 40 brings the black photoreceptor drum 1K in pressure contact with the intermediate transfer member 6 (S28), and executes the image formation in the monochromatic mode (S29). Then, process proceeds to Step S21.

Thus, when the image formation in the monochromatic mode is performed continuously following the image formation in the color mode, the slight rotation operation is arranged not to be performed after switching the transmission member to the non-transmitted state. That is, since the job is continuous and to prevent the problem of the image blur caused by ozone or the image deterioration due to humidity, the slight rotation operation will not be performed after the switching of the transmission member.

Incidentally, when the previous job is determined not to be the image formation in the color mode (S22: NO), that is, when the previous job was the image formation in the monochromatic mode, the controller 40 determines whether the next job is the image formation in the color mode or not (S30). When the next job is determined to be the image formation in the color mode (S3: YES), that is, when the image formation in the monochromatic mode is switched to the image formation in the color mode, the controller 40 releases the pressure contact of the black photoreceptor drum 1K and the intermediate transfer member 6 (S31). The controller 40 performs the phase adjusting process to adjust phase of each photoreceptor drums 1Y, 1M, 1C and 1K (S32). Next, the controller 40 switches the transmission member to the transmitted state (S33).

Then, the controller 40 controls the image forming unit GH, and switches the line speed to the color mode line speed (S34). Next, the controller 40 brings all of the photoreceptor drums 1Y, 1M, 1C and 1K in pressure contact with the intermediate transfer member 6 (S35), and executes the image formation in the color mode (S36). Then, the process proceeds to Step S21.

Thus, when the image formation in the color mode is performed continuously following the image formation in the monochromatic mode, the slight rotation operation is arranged not to be performed after switching the transmission member to the transmitted state. That is, since the job is continuous and to prevent the problem of the image blur caused by ozone or the image deterioration due to humidity, the slight rotation operation will not be performed.

An adjustment of number of rotation of the first motor 35 and the second motor 36 may be performed in place of the process of the above-mentioned Step S33. That is, the transmission member will be maintained in the non-transmitted state. By adjusting the number of rotations of the first motor 35 and the second motor 36, both motors 35 and 36 will rotate at the same number of rotations without going through the transmission member, and image formation will be executed. Thereby, not only the slight rotation operation, but also the switching of the transmission member can be omitted. Thus, the waiting time can be shortened further.

When the transmission member is not switched as mentioned above, the transmission member will be in the non-transmitted state even after the image formation in the color mode was performed. Therefore, in the above-mentioned case, switching the transmission member to the transmitted state after each of the already described Step S7 is necessary. It is also necessary to arbitrarily change other steps.

When the next job is determined not to be the image formation in the color mode (S30: YES), that is, when the image formation in the monochromatic mode continues from the previous job to the next job, the controller 40 executes the image formation in the monochromatic mode (S37). Then, the process proceeds to Step S21.

Thus, according to the image forming apparatus related to this embodiment, the drive mechanism 30 is provided with the movable idler gear 34 or the vertical motion idler gear 38 as the transmission member. The transmission member is in the non-transmitted state in the monochromatic mode. However, after the execution of image formation in the monochromatic mode, when the execution of next image formation is not instructed, the transmission member will be in the transmitted state after the end of the phase adjusting process for adjusting phase of each photoreceptor drums 1Y, 1M, 1C and 1K. Therefore, three photoreceptor drums 1Y, 1M and 1C and the black photoreceptor drum 1K will be in the connected state by the transmission member. When the transmission member is in the transmitted state, the second motor 36 executes the slight rotation operation for every prescribed period of time. Therefore, the second motor 36 slightly rotates three photoreceptor drums 1Y, 1M and 1C and the black photoreceptor drum 1K in the connected state. Not only the three photoreceptor drums 1Y, 1M and 1C, but also the black photoreceptor drum 1K will be synchronized with the three photoreceptor drums 1Y, 1M and 1C and slightly rotated via the transmission member. Thereby, the image blur caused by ozone and the image deterioration due to humidity are regulated. Particularly, since the transmission member will be in the transmitted state after the end of the phase adjusting process, the phase of each photoreceptor drums 1Y, 1M, 1C and 1K will not deviate even when a plurality of photoreceptor drums 1Y, 1M, 1C and 1K are slightly rotated to suppress the image blur caused by ozone or the image deterioration due to humidity. Thus, the phase of each photoreceptor drums 1Y, 1M, 1C, and 1K will not deviate, and will prevent the extension of the first copy out time. Therefore, the image blur caused by ozone and the image deterioration due to humidity can be regulated while the shortening of the first copy out time is attained.

When the transmission member is in the transmitted state in the color mode and the execution of next image formation is not instructed after the execution of image formation in the color mode, the transmission member is maintained in the transmitted state. The second motor 36 executes the slight rotation operation for every prescribed period of time after the execution of image formation in the color mode. Here, since the phase of each photoreceptor drums 1Y, 1M, 1C and 1K are adjusted at the time of the termination of the image formation in the color mode, only the slight rotation operation is performed while maintaining the transmission member in the transmitted state without executing the phase adjusting process. Therefore, the image blur caused by ozone and the image deterioration due to humidity can be suppressed while omitting the unnecessary control of switching the state of the transmission member after the end of the image formation in the color mode.

When the execution of next image formation is instructed in the monochromatic mode, the transmission member becomes non-transmitted state. After the transmission member is in the non-transmitted state, image formation will be executed after the first motor 35 rotates the black photoreceptor drum 1K. Thus, even when the execution of image formation in the monochromatic mode is instructed after adjusting the phases once and slightly rotating each photoreceptor drums 1Y, 1M, 1C and 1K, the apparatus will be in a state in which the execution of image formation in the monochromatic mode becomes possible just by switching the transmission member from the transmitted state to the non-transmitted state. Thus, the first copy out time does not become so long and the image blur caused by ozone and the image deterioration due to humidity can be suppressed.

When the execution of next image formation in the color mode is instructed continuously following the execution of image formation in the monochromatic mode, the transmission member shifts to the transmitted state after the termination of the phase adjusting process. The second motor 36 rotates a plurality of photoreceptor drums 1Y, 1M, 1C and 1K without executing the slight rotation process, and then image formation is executed. Thus, when the execution of image formation in the color mode is instructed continuously following the execution of image formation in the monochromatic mode, since the slight rotation operation is unnecessary, the execution of image formation in the color mode can be executed after the phase adjusting process. Therefore, the image formation in the color mode can be performed while omitting the slight rotation process.

When the execution of next image formation in the color mode is instructed continuously following the execution of image formation in the monochromatic mode, the number of rotation of the first motor 35 and the second motor 36 are adjusted after the phase adjusting process ends. The first motor 35 rotates only the black photoreceptor drum 1K, and then image formation is executed. The second motor 36 rotates three photoreceptor drums 1Y, 1M and 1C without executing the slight rotation operation, and then image formation is executed. Thus, when the execution of next image formation in the color mode is instructed continuously following the execution of image formation in the monochromatic mode, the transmission member will be maintained in the non-transmitted state without shifting to the transmitted state. By adjusting the number of rotations of the first motor 35 and the second motor 36, both motors 35 and 36 will rotate at the same number of rotations via the transmission member, and then image formation will be executed. Thereby, the image formation in the color mode can be executed without switching the transmission member. Therefore, the image formation in the color mode can be performed while omitting the switching of the transmission member and the slight rotation operation.

When the execution of next image formation in the monochromatic mode is instructed continuously following the execution of image formation in the color mode, the transmission member shifts to the non-transmitted state. The first motor 35 rotates the black photoreceptor drum 1K without executing the slight rotation operation, and then image formation is executed. Thus, when the execution of next image formation in the monochromatic mode is instructed continuously following the execution of image formation in the color mode, the slight rotation operation becomes unnecessary. Further, since the execution of image formation in the monochromatic mode is instructed, the phase adjusting process also becomes unnecessary. Therefore, the image formation in the monochromatic mode can be performed while omitting the unnecessary controls, such as the slight rotation operation and the phase adjusting process.

The image forming apparatus related to the present invention was described based on the embodiments in the above. However, the present invention is not limited to the above-mentioned embodiments. Changes may be added in a range, which does not depart from the scope of the present invention.

For example, in the above-mentioned embodiment, although a copying machine was mentioned as an example of the image forming apparatus, it is not limited to the copying machine. A device, which performs the image formation of colors that varies by each of a plurality of photoreceptor drums, such as multifunction peripheral, can be applied. In the above-mentioned flow charts illustrated in FIG. 5 and FIG. 6, an example of an operation in which the movable idler gear 34 or the vertical motion idler gear 38 is switched as the transmission member by stopping the motors 35 and 36 was illustrated. However, the operation is not limited to this. The switching of the movable idler gear 34 or the vertical motion idler gear 38 as the transmission member may be performed without stopping the motors 35 and 36. In this case, a part of the flow charts may be changed. However, the present embodiment is not limited by the flow chart.

In the above-mentioned embodiment, the slight rotation process is performed after determining the elapse of the prescribed period of time in Step S9. However, the prescribed period of time does not need to be a fixed time. The prescribed period of time may vary as determined by a calculation and may be different each time. Further, for example, a process that performs the slight rotation process based on an observation result obtained from observing the state of each photoreceptor drums 1Y, 1M, 1C and 1K by sensor may be executed in place of the process of the slight rotation process performed after the elapse of the prescribed period of time. Even in this case, as a result, the slight rotation operation will be performed for every prescribed period of time.

What is claimed is:

1. An image forming apparatus having a color mode in which a color image is formed on a recording medium by rotating and driving a plurality of photoreceptor drums, and a monochromatic mode in which a monochromatic image is formed on a recording medium by a single photoreceptor drum of the plurality of photoreceptor drums by rotating and driving the single photoreceptor drum, the image forming apparatus comprising:

a first motor which rotates only the single photoreceptor drum of the plurality of photoreceptor drums;

a second motor which rotates the plurality of photoreceptor drums;

a transmission member, which is capable of being switched between a transmitted state where the second motor transfers a drive force to the single photoreceptor drum and a non-transmitted state where the second motor does not transfer the drive force to the single photoreceptor drum; and a controller which controls a rotation speed of the second motor and a switching of the transmission member between the transmitted state and the non-transmitted state, wherein the controller switches the transmission member to the non-transmitted state while executing an image formation in the monochromatic mode, and when a command to execute a next image formation is not instructed after having executed the image formation in the monochromatic mode, switches the transmission member to the transmitted state after a phase adjusting process that adjusts a phase of each photoreceptor drum has been completed, and controls the second motor to execute a slight rotation operation which executes a slight rotation at every prescribed period of time by synchronizing the plurality of photoreceptor drums including the single photoreceptor drum with each other through the transmission member after the transmission member has been switched to the transmitted state.

2. The image forming apparatus of claim 1, wherein the controller switches the transmission member to the transmitted state while executing an image formation in the color mode, makes the transmission member to maintain the transmitted state when a command to execute a next image formation is not instructed after having executed the image formation in the color mode, and controls the second motor to execute the slight rotation at every prescribed period of time.

3. The image forming apparatus of claim 1, wherein the controller further controls a rotation speed of the first motor, and switches the transmission member to the non-transmitted state when a command to execute a next image formation in the monochromatic mode is instructed after having executed the image formation, and controls the first motor to execute the next image formation in the monochromatic mode by rotating the single photoreceptor drum.

4. The image forming apparatus of claim 1, wherein the controller switches the transmission member to the transmitted state when a command to execute a next image formation in the color mode is instructed continuously following the execution of an image formation in the monochromatic mode after having executed the image formation in the monochromatic mode, and after the phase adjusting process has been completed, controls the second motor to execute the next image formation in the color mode by rotating the plurality of photoreceptor drums without executing the slight rotation after the transmission member has been switched to the transmitted state.

5. The image forming apparatus of claim 1, wherein the controller further controls a rotation speed of the first motor, adjusts the number of rotations of the first motor and the second motor while maintaining the transmission member to be in non-transmitted state after the execution of the image formation in the monochromatic mode has been completed and after the phase adjusting process, when the execution of next image formation is instructed in the color mode continuously following the execution of an image formation in the monochromatic mode, controls the first motor by rotating only the single photoreceptor drum to execute the image formation without executing the slight rotation after the adjustment of the number of rotations, and controls the second motor by rotating the plurality of photoreceptor drums excluding the single photoreceptor drum to execute an image formation.

6. The image forming apparatus of claim 1, wherein the controller further controls a rotation speed of the first motor, switches the transmission member to the non-transmitted state when the execution of a next image formation in the monochromatic mode is instructed in the color mode continuously following the execution of an image formation in the color mode, and controls the first motor by rotating the single photoreceptor drum to execute the next image formation in the monochromatic mode without executing the slight rotation after the transmission member has been switched to the non-transmitted state.

7. The image forming apparatus of claim 1, wherein the controller controls the second motor to execute the slight rotation operation in which the plurality of photoreceptor drums are rotated by a prescribed angle at every prescribed period of time.

* * * * *